US006796445B2

(12) United States Patent
Cyrluk

(10) Patent No.: US 6,796,445 B2
(45) Date of Patent: Sep. 28, 2004

(54) SHELF-FRONT ASSEMBLY FOR LABELING AND RETAINING PRODUCTS

(76) Inventor: Issac Cyrluk, 20 W. Pamrapo Ct., Glen Rock, NJ (US) 07452

( * ) Notice: Subject to any disclaimer, the term of this patent is extended or adjusted under 35 U.S.C. 154(b) by 0 days.

(21) Appl. No.: 10/449,413

(22) Filed: Jun. 2, 2003

(65) Prior Publication Data

US 2003/0196979 A1 Oct. 23, 2003

Related U.S. Application Data

(62) Division of application No. 09/397,642, filed on Sep. 16, 1999, now Pat. No. 6,571,498.
(60) Provisional application No. 60/100,630, filed on Sep. 16, 1998.

(51) Int. Cl.[7] ..... A47F 5/00
(52) U.S. Cl. ..... 211/183; 211/184; 211/90.01
(58) Field of Search ..... 211/183, 119.003, 211/59.2, 184, 134, 59.4; 40/661.03, 642.02, 649, 651; 108/60, 61, 27

(56) References Cited

U.S. PATENT DOCUMENTS 2,640,288 A * 6/1953 Orlin
2,730,825 A * 1/1956 Wilds ..... 40/650
3,308,963 A * 3/1967 Peacock ..... 211/134
3,512,652 A * 5/1970 Armstrong ..... 211/134
4,606,280 A * 8/1986 Poulton et al. ..... 108/97
4,613,047 A * 9/1986 Bushyhead et al. ..... 211/55
4,615,276 A * 10/1986 Garabedian ..... 108/61
4,712,694 A * 12/1987 Breslow ..... 211/184
4,775,058 A * 10/1988 Yatsko ..... 211/184
4,874,099 A * 10/1989 Arnott et al. ..... 211/50
4,896,779 A * 1/1990 Jureckson ..... 211/184
5,255,802 A * 10/1993 Krinke et al. ..... 211/184
5,341,945 A * 8/1994 Gibson ..... 211/184
5,408,775 A * 4/1995 Abramson et al. ..... 40/655
5,419,066 A * 5/1995 Harnois et al. ..... 40/661.03
5,577,337 A * 11/1996 Lin ..... 40/642.02
5,577,623 A * 11/1996 Bustos ..... 211/187
5,673,801 A * 10/1997 Markson ..... 211/59.3
5,682,824 A * 11/1997 Visk ..... 108/60
5,690,038 A * 11/1997 Merit et al. ..... 108/60
5,839,588 A * 11/1998 Hawkinson ..... 211/59.3
6,006,678 A * 12/1999 Merit et al. ..... 108/60
6,041,720 A * 3/2000 Hardy ..... 108/60
6,047,647 A * 4/2000 Laraia, Jr. ..... 108/61
6,226,910 B1 * 5/2001 Ireland ..... 40/661.03
6,227,385 B1 * 5/2001 Nickerson ..... 211/59.3
6,299,004 B1 * 10/2001 Thalenfeld et al. ..... 211/184
6,571,498 B1 * 6/2003 Cyrluk ..... 40/661.03

* cited by examiner

*Primary Examiner*—Jennifer E. Novosad
(74) *Attorney, Agent, or Firm*—Rothwell, Figg, Ernst & Manbeck; Stephen B. Parker

(57) ABSTRACT

Methods for making, etc., a shelf-front assembly, including, in some embodiments, extruding a plastic strip having 1) a generally horizontal floor and 2) an upward wall extending up from the generally horizontal floor; cutting a length of the plastic strip, attaching the length of the plastic strip on a shelf by sliding a portion of the generally horizontal floor under an overhanging member, and laying the generally horizontal floor on a generally horizontal portion with a blocking element in front of a retaining surface of the strip.

27 Claims, 10 Drawing Sheets

SHELF-FRONT ASSEMBLY FOR LABELING AND RETAINING PRODUCTS

The present application is a divisional of and claims priority under 35 U.S.C. 120 to application Ser. No. 09/397,642, filed on Sep. 16, 1999, now U.S. Pat. No. 6,571,498, which in turn, claims priority to Provisional Application Ser. No. 60/100,630 filed on Sep. 16, 1998, the entire disclosures of which priority applications are both incorporated herein by reference as though recited herein in full.

BACKGROUND OF THE INVENTION

1. Field of the Invention

The present invention pertains to the organization of merchandise on shelves for retail, display, or the like. In particular, the present invention involves an improved shelf-front assembly for labeling and/or retaining products.

More particularly, the preferred embodiments of the present invention involve a unique manner of combining both a) a label holder and b) a front product retaining wall. The most preferred embodiments of the present invention involve a novel means to quickly, easily and securely change both a) labels and b) front retaining walls on a shelf to accommodate different or new product types.

2. Background of the Invention

There are a variety of existing label holders that are attachable to shelves for displaying product information, such as prices and other characteristics. For example, elongated channels for removably attaching labels, such as label cards that fit within the channels, are known.

There are also existing front retaining walls that retain products on shelves. However, such front retaining walls typically require attachment to be made with tools and/or additional parts, such as nails, bolts or the like. When a retaining wall is not attached with tools and/or additional parts, the retaining wall can become flimsy and insecure and/or can require excess material or structure.

Examples of existing devices are shown in the following U.S. Patent Nos.: 1) U.S. Pat. No. 2,640,288; 2) U.S. Pat. No. 4,775,058; 3) U.S. Pat. No. 4,896,779; 4) U.S. Pat. No. 5,341,945; 5) U.S. Pat. No. 5,419,066; and 6) U.S. Pat. No. 5,557,337, the entire disclosures of which are incorporated herein by reference.

The '337 patent shows a positioning assembly for shelf placards and separators having a longitudinal blocking frame 30 and a placard holder 40. As illustrated, the device includes a transverse bottom plate 10 having a longitudinal slot that receives an inserting end 31 of the frame 30. Among other things, the apparatus is complicated and requires excess material to secure the blocking frame 30.

The '288 patent shows a device in FIG. 2 wherein a price tag holder hangs on the edge of a shelf. The holder includes a tapered rear flange 20 that is attached to the shelf. As stated on column 3 of the '288 patent, "the head portion 18 is vertically slotted from the upper edge as at 19 to receive the lower edge of a card, sign or the like, which may designate the name, quality or other characteristics of the goods offered." The patent indicates that the "sloping upper face 21 [of the flange 20] prevents articles from sliding off the shelf by vibration or the like even in the absence of a card in slot 19" but that "[s]uch card 23, however, increases the security of goods on the shelf." Although the "card" may increase the security of the goods on the shelf, the card is not securely mounted thereto nor is the card disclosed as being constructed of a suitable material to serve as a product front retaining wall in various circumstances.

There continues to be a need for an improved system by which labels and/or front retaining walls can be securely, quickly and easily changed to accommodate different or new product types.

SUMMARY OF THE INVENTION

The present invention solves the above and other problems and provides an improved system by which labels and front retaining walls can be securely, quickly and easily changed to accommodate different or new product types.

According to a first aspect of the invention, a shelf-front assembly is provided which includes: a first plastic strip having a generally horizontal portion for placement on a shelf surface; a second plastic strip having 1) a generally horizontal floor and 2) an upward wall extending up from the generally horizontal floor; the first plastic strip being attachable on a shelf with the generally horizontal portion on a top surface of the shelf; the first plastic strip having a top snap-fit element running lengthwise along the first plastic strip and having an overhanging member running parallel to the top snap-fit element; the second plastic strip having a bottom snap-fit element running lengthwise along the generally horizontal floor and an end of the generally horizontal floor fittable under the overhanging member; the first plastic strip being attachable to the second plastic strip with the top and bottom snap-fit elements snap-fit together and with the overhanging member overhanging the end of the generally horizontal floor portion.

According to another aspect of the invention, a shelf-front assembly is provided which includes: a first extruded plastic strip having 1) a label holder and 2) a generally horizontal portion extending rearward from the label holder; a second extruded plastic strip having 1) a generally horizontal floor and 2) an upward wall extending up from the generally horizontal floor; the generally horizontal portion of the first strip having integrally extruded front and rear mechanical engagement portions extending continuously along the entire length of the first strip for engaging the generally horizontal floor of the second strip at forward and rearward positions to attach the second strip to the first strip without external attaching means. Preferably, the generally horizontal floor has a width in a front to rear direction that is substantially greater than a corresponding width of the upward wall, such as (in one example) more than five times wider. Preferably, the generally horizontal floor and the upward wall are generally planar walls extending transverse to one another. The floor and upward walls, however, can have other configurations. Preferably, at least one of the engagement portions is a snap-fit element that snap-fits to the generally horizontal floor of the second plastic strip and at least one of the engagement portions is an overhanging member that overhangs an end of the generally horizontal floor of the second plastic strip.

According to another aspect of the invention, a method of making a shelf-front assembly is provided which includes the steps of: extruding through a first extrusion die a first plastic strip having 1) a generally horizontal portion for placement on a shelf surface, 2) a label holder at one end of the generally horizontal portion, 3) a front-motion blocking element, and 4) an overhanging member extending along a top surface of the generally horizontal portion; cutting a length of the first plastic strip; extruding through a second extrusion die a second plastic strip having 1) a generally horizontal floor and 2) an upward wall extending up from the generally horizontal floor; cutting a length of the second plastic strip; attaching the length of the first plastic strip on a shelf top surface with the generally horizontal portion on the shelf top surface and the label holder member proximate a front side of the shelf; attaching the length of the second plastic strip on the first plastic strip by sliding one end of the generally horizontal floor under the overhanging member and laying the generally horizontal floor on the generally horizontal portion of the first strip with the front-motion blocking element in front of a retaining surface of the second strip to retain the length of the second strip in position on the length of the first strip.

According to another aspect of the invention, a shelf-front assembly is provided that includes: a first strip having 1) a generally horizontal portion for placement on a shelf surface and 2) a label holder at a front end of the generally horizontal portion; a second strip having an upward wall extending upward from a widened base; the first strip being attachable on a shelf with the generally horizontal portion on a top surface of the shelf and the label holder proximate a front side of the shelf; the first strip having at least one engaging element running lengthwise along the entire top surface of the generally horizontal portion; the base of the second strip having at least one engaging element running lengthwise along the entire length of the second strip; the first strip being manually attachable to the second strip by manually engaging the engaging elements of the first and second strips. Preferably, the first and second strips are extruded plastic strips.

According to another aspect of the invention, a shelf-front assembly is provided which includes: a first elongated strip having 1) a generally horizontal portion for placement on a shelf surface, 2) a label holder at one end of the generally horizontal portion, 3) an overhanging member extending lengthwise along a top surface of the generally horizontal portion, and 4) a front-motion blocking surface; a second elongated strip having 1) a generally horizontal floor and 2) an upward wall extending up from the generally horizontal floor; the first strip being attachable on a shelf top surface with the generally horizontal portion on the shelf top surface and the label holder proximate a front end of the shelf; the second strip being detachably connectable on the first strip by sliding one end of the generally horizontal floor under the overhanging member and laying the generally horizontal floor on the generally horizontal portion of the first strip with the front blocking surface extending in front of a retaining surface of the second strip to retain the second strip on the first strip.

According to another aspect of the invention, a shelf-front assembly is provided which includes: a first strip having a generally horizontal portion for placement on a shelf surface; a second strip having an upward wall extending upward from a widened base; the first strip being attachable on a shelf with the generally horizontal portion on a top surface of the shelf; means integrally formed on both the first and second strips for manually engaging the widened base of the second strip directly on the generally horizontal portion of the first strip at a location over the top surface of the shelf.

According to another aspect of the invention, a shelf-front assembly kit is provided which includes: a first strip having a generally horizontal portion for placement on a shelf; a second strip having 1) a generally horizontal floor and 2) an upward wall extending up from the generally horizontal floor and having a height H1; the first strip being attachable on a shelf with the generally horizontal portion on a top surface of the shelf; the first strip having at least one top manually engaging element running lengthwise along a length of the generally horizontal portion; the second strip having at least one bottom manual engaging element running lengthwise along a length of the generally horizontal floor; the first strip being manually attachable to the second strip by manually engaging the top and bottom engaging elements together; a modified second strip having 1) a generally horizontal floor and 2) an upward wall extending up from the generally horizontal floor and having a height H2 that is substantially greater than the height H1; the modified second strip having at least one bottom manual engaging element running lengthwise along a length of the generally horizontal floor of the modified second strip; the first strip also being manually attachable to the modified second strip by manually engaging the top engaging element of the first strip with the bottom engaging element of the modified second strip; whereby the first strip is attachable to a shelf and the second strip and the first strip are manually interchangeably attachable to said first strip to vary between the heights H1 and H2 as desired.

Advantages of the Invention

The present invention has substantial advantages and benefits over the existing art. The advantages discussed herein are not necessarily applicable to each and every aspect or embodiment.

One advantage is that the present invention can be easily and inexpensively fabricated. The present invention can also be constructed with a limited amount of material. The present invention also can be minimized to prevent obstruction and/or interference with normal shelf use. Nevertheless, the assembled device can be very strong and stable to provide a strong and stable shelf-front retaining wall.

The present invention can also be easily handled and manipulated. A store owner does not need to have additional parts or tools for assembly. The present invention enables a store owner to change the retaining wall type very easily as needed. During normal store operation, a store owner may often desire to rearrange products on shelves or to provide new products on shelves. Rearranging and/or reorganizing products on shelves can be very time consuming and difficult. Valuable time and money can be lost during such rearranging and/or reorganizing. When products are not well organized and/or accommodated on a shelf, the products can be damaged (e.g., if products fall off the shelves) and consumers can have difficulty locating products and can become dissatisfied with shopping under such conditions. Accordingly, it can be important to be able to quickly and easily rearrange and/or reorganize products as desired.

With the preferred embodiments of the present invention, a store owner can quickly attach a shelf-front wall as may be desired for a particular product type. A store owner can also have an employee change the assembly as needed because no additional parts are needed and little or no instruction is needed. As a result, a front wall can be set at a desired height sufficient to retain products. In addition, if desired, shelf-front walls of various types can be used as desired, such as clear walls, opaque walls, printed walls, etc. The rearrangement and/or reorganization of products is thus greatly facilitated.

The above and other advantages, features and aspects of the present invention will be more readily perceived from the following description of the preferred embodiments thereof taken together with the accompanying drawings and claims.

BRIEF DESCRIPTION OF THE DRAWINGS

The present invention is illustrated by way of example and not limitation in the accompanying drawings, in which like references indicate like parts, and in which.

DETAILED DESCRIPTION OF THE PREFERRED EMBODIMENTS

Figure 1A:
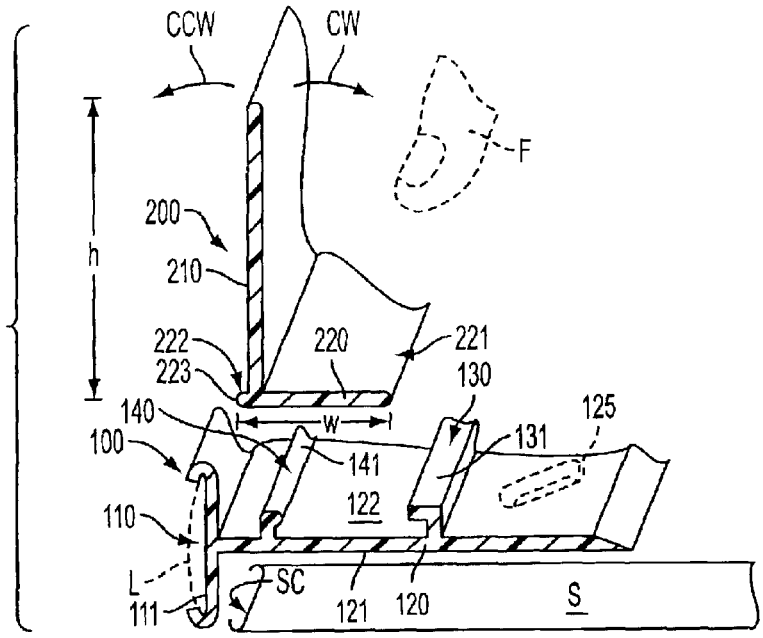
FIG. 1(A) is a perspective/cross-sectional view of a first embodiment of the invention.

The preferred embodiments of the present invention include an assembly having a holder member 100 and a front retaining wall member 200. In the drawings, like reference numerals are used for similar parts. FIG. 1(A) shows a first preferred embodiment of the invention, and FIGS. 1(B) through 2(D) show alternative embodiments having similarities to the embodiment shown in FIG. 1(A).

Holder Member

The holder member 100 preferably has a label holder 110 and a generally horizontal portion 120 that extends rearwardly from the label holder 110.

The label holder 110 preferably has means for holding a label to display product information. In the most preferred embodiments, the label holder 110 includes a channel 111 for containing a label L, such as a card or the like. Alternatively, although less preferred, other forms of label holders can be provided. As one example, a placard holder of the type shown in U.S. Pat. No. 5,577,337—the disclosure of which is incorporated herein by reference—can be used (see, e.g., element 40 in the '337 patent). As another example, the label holder 110 can include a generally flat surface for fixing labels thereto via adhesives or the like. As discussed below, the label holder 110 can also include means for holding another label holder element, such as the element 300 shown in FIGS. 3(A), 3(B) and 3(D). In addition, the label holder 110 can be modified to include other structural configurations for mounting a label or a label holding element. As shown in FIG. 3(C), the label holder 110 can also be omitted, such as when no label is desired.

The horizontal portion 120 preferably has a generally horizontal lower surface 121 for placement upon a shelf S and an upper surface 122 having means for attaching the front retaining wall member 200.

Retaining Wall Member

Figure 8A:
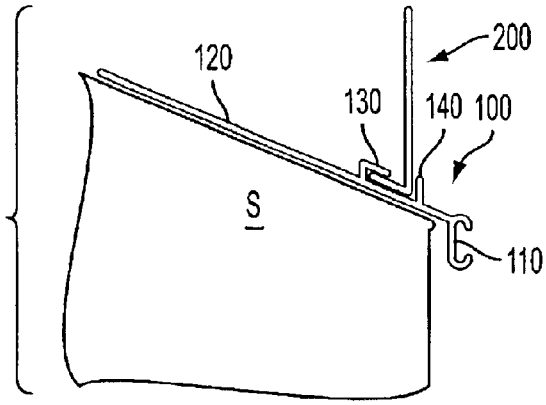
FIG. 8(A) is a schematic side view of an embodiment of the invention assembled on a sloped shelf front.

The retaining wall member 200 preferably has a generally horizontal base or floor 220 and a retaining wall 210 extending upward from the floor 220. The floor 220 is preferably generally flat. The shape of the floor 220 can be varied, but the floor 220 preferably has multiple points of contact (two or more) against the holder member 100 (e.g., proximate a front end and a rear end of the floor 220) for enhanced stability. The retaining wall 210 is preferably transparent or clear to facilitate viewing of product on the shelf S. However, it can also be opaque, and it can also include labels, printing, or label holding means such as a channel thereon. The wall 210 is also preferably generally flat and vertical. However, the shape and orientation can be modified as desired. For example, depending on circumstances, the retaining wall 210 can be formed at an obtuse angle or at an acute angle to the floor 220. As one example, an acute angle may be desired when the shelf S slopes downward toward the front of the shelf, such as shown in FIG. 8(A).

As shown in FIG. 1(A), for example, the retaining wall 210 preferably extends upward from the floor 220 at or near a front end 222 of the floor 220. In this manner, when attached to the holder member 100, the retaining wall 210 can be closer to the front of the shelf S to increase the area for products on the shelf. Alternatively, the wall 210 can extend up from the floor 220 at any location between the rear end and the front end of the floor 220.

Attachment Method

Preferably, a user initially attaches a holder member 100 on a shelf S. The holder member 100 can be attached to the shelf S by nails, screws, bolts, adhesives or the like. The holder member 100 can be permanently, semi-permanently or releasably attached to the shelf. The portion 120 preferably includes holes or slots 125 for receiving bolts, screws or the like connectors for attachment to the shelf S.

After attachment of the holder member 100, a retaining wall member 200 can be attached by hand for example. Although less preferred, the retaining wall member 200 can be attached to the holder member 100 prior to attaching the member 100 to the shelf.

The member 200 is preferably attached to the member 100 manually without the need for additional tools, such as nails or the like. Preferably, the members 100 and 200 are snap-fit together, while the base 220 enhances the stability of the structure. Most preferably, the front and rear sides of the base 220 are restrained to further enhance stability. The front and rear ends of the member 200 may be snap-fit, for example, to the member 100. Most Preferably, however, one of the front and rear ends includes an engagement formed by an overhanging member that inhibits movement of the member 200 to increase stability.

Figure 4:
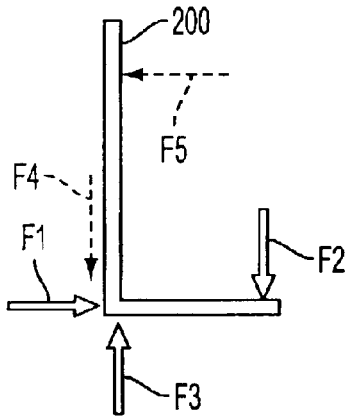
FIG. 4 is a schematic diagram illustrating restraining forces on a retaining wall element.

As discussed with reference to the more preferred embodiments below, as shown in FIG. 4, the member 100 preferably includes: a) a first means for applying a blocking force F1 to block (i.e., inhibit) forward motion of the second plastic strip; b) a second means for applying a downward blocking force F2 at a rear end of the generally horizontal portion of the second strip; and c) third means for applying an upward blocking force F3 at a front end of the generally horizontal portion of the second strip.

A First Preferred Embodiment

FIG. 1(A) shows a first preferred embodiment of the invention. In the embodiment shown in FIG. 1(A), the second means includes an overhanging member 130 that extends over a rear end 221 of the floor 220 when attached. Preferably, the first means includes an upward protrusion 140 that extends in front of the front end 222 of the floor 220 when attached. In the embodiment shown in FIG. 1(A), the upper surface 122 acts as the third means preventing such downward movement.

In this manner, the retaining wall member 200 can be attached to the holder member 100 by sliding the rear end 221 of the floor 220 under the overhanging member 130 and lowering the floor 220 to a position in between the upward protrusion 140 and the overhanging member 130. As a result, the forward portion 131 of the overhanging member 130 can prevent the member 200 from rotating in a counter-clockwise direction CCW. That is, the portion 131 overlaps the rear end 221 to prevent the rear end 221 from moving upward. The upward protrusion 140 prevents the member 200 from moving forward to ensure that the overhanging member 130 remains in a proper blocking position. The overhanging member 130 preferably extends over the rear end 221 a sufficient distance to prevent the member 200 from being rotated, without breaking or deforming the member 200 and/or the overhanging member 130. The overhanging member preferably does not merely provide a "snap-fit" securing force, but a stronger force based on the strength of the materials to resist fracture or structural deformation. The wall 210 can preferably resist a substantial force acting in the counter-clockwise direction CCW. As a result, e.g., products retained on the shelf can press against the wall 210 without causing the wall 210 to pivot counter-clockwise, and the wall 210 can easily resist a customer's inadvertent contact with the wall 210 when removing products from the shelf S. Some exemplary preferred embodiments of the invention can withstand a force F5, FIG. 4, applied at about 1 to 5 inches above the floor 220, of about 3 lbs., or even about 5 lbs., or even about 7 lbs., or even about 9 lbs., or even about 11 lbs. or more per linear foot. The force F5 capable of being withstood can vary significantly depending on circumstances.

In the most preferred embodiments, in addition to blocking forward motion, a snap-fit connection is also included. In this regard, in the embodiment shown in FIG. 1(A), the upward protrusion 140 preferably has a rearward bulge portion 141 that snap-fits over a front bulge portion 223 of the floor 220. In this manner, the member 200 can be very securely attached to the holder member 100. This "snap-fit" engagement will provide a fourth force means that creates a fourth force F4 to further resist rotation in a clockwise direction CW (the overhanging member 130 and/or the surface 122 proximate thereto can also be configured to provide a degree of resistance to clockwise movement).

Thus, the member 200 can be easily, quickly and securely attached by sliding the end 221 under the overhanging member 130 and snap-fitting the end 222 to the protrusion 141. For example, one can grasp the wall 210 and push the end 222 downward and/or one can use one's finger(s) F to press the floor 220 down to snap the members together. The present invention can, thus, provide a very stable structure that requires no additional parts and that can easily be attached by hand.

In order to remove the retaining wall member 200, the member 200 can be rotated in a clockwise direction CW (disengaging the snap-fit connection, when used) and the rear end 221 can be pulled out from under the overhanging member 130. Then, if desired, a new member 200 can be attached in a similar manner to that discussed above. If desired, the member 200 can also be omitted. The portions 130 and 140 can be constructed relatively small to avoid interference with products on the shelf S over substantially the entire upper surface 122. Accordingly, when the member 200 is not needed, or not desired, it can be removed without limiting the operability or the appearance of the shelf S.

Additional Embodiments

Figure 1B:
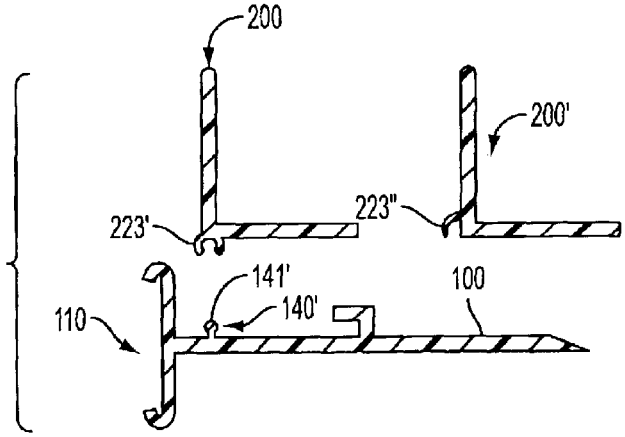
FIGS. 1(B) through 1(D) are each cross-sectional side views showing alternative embodiments of the invention.

FIG. 1(B) shows another embodiment of the invention wherein the first means for applying a blocking force F1 to block forward motion of the second plastic strip is modified to include an upward protrusion 140' having a cross-section with an outer bulge 141' that snap-fits into a flexible channel 223' on the member 200. As with the snap-fit embodiment shown in FIG. 1(A), the snap-fit engagement in this embodiment both prevents forward movement and provides a force F4 resisting clockwise movement. FIG. 1(B) also illustrates a second member 200' having an alternative construction of the channel, e.g., channel 223" (it is contemplated that the snap-fit engagement can be formed in a variety of ways as should be understood by those in the art based on this disclosure).

Figure 1C:
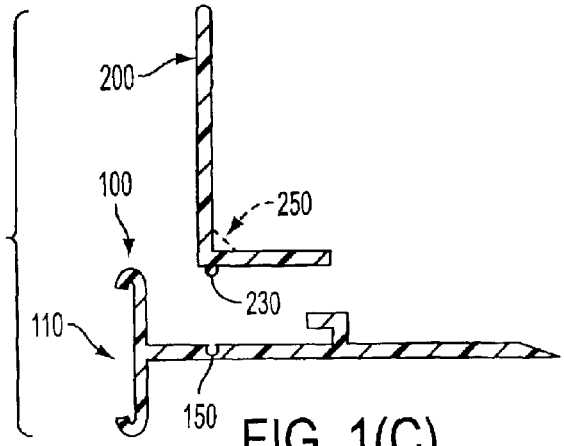

FIG. 1(C) shows another manner of snap-fitting the members together. In this embodiment, the member 200 has a protrusion 230 similar to the protrusion 140' of FIG. 1(B) and the member 100 has a slot 150 for snap-fitting the protrusion 230. In another alternative, the slot 150 can be modified to be similar to the channel 223' shown in FIG. 1(B), e.g., extending upward from the surface 122.

Figure 1D:
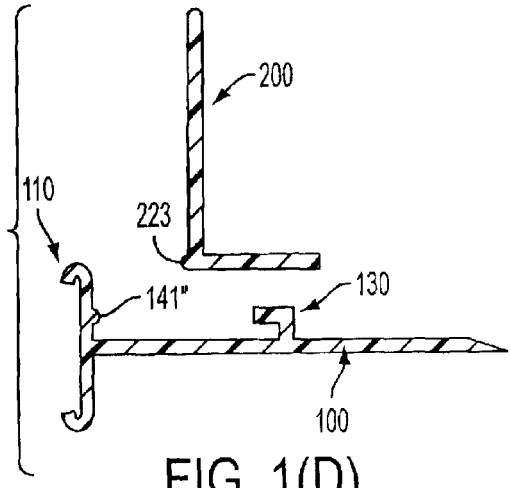

FIG. 1(D) shows another embodiment wherein the label holder 110 is used as the first means for applying a blocking force F1 to block forward movement of the second plastic strip. This embodiment can also include means to provide a snap-fit, such as a bulge 141" that functions like the bulge 141 to snap-fit with the portion 223 of the member 200.

In each of the above-noted preferred embodiments, the rearward end 221 of the member 200 is secured by an overhanging member 130 and the forward end 222 of the member 200 is, in the preferred constructions, snap-fit to the member 100. It is contemplated that any known snap-fit configuration can be used to provide such a snap-fit between the members 100 and 200. Although the snap-fit connection is most preferably proximate the front of the member 200 as shown (e.g., for increased stability, etc.), the snap-fit location can be moved further towards the rear end of the floor 220 towards the overhanging member 130.

As shown in dashed lines in FIG. 1(C), the member 200 can also have a widened base 250 at the connection to the floor 220 to increase the strength of the connection. A widened base 250 can also be used in the other embodiments of the invention.

Figure 2A:
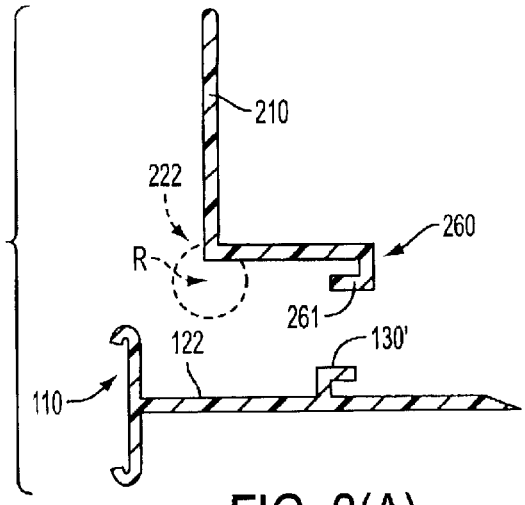
FIG. 2(A) through 2(D) are each cross-sectional side views showing other alternative embodiments of the invention.

FIGS. 2(A) illustrates another, although less preferred, embodiment of the invention wherein the rear end 221 of the member 200 is modified to include a forwardly extending hook 260 and wherein the overhanging member 130' is modified to extend over a lower portion 261 of the hook. In this embodiment, the member 130' can provide both the first force F1 and the second force F2. Nevertheless, to enhance stability of the wall 210, the front end 222 is still preferably snap-fit (e.g., at a region R) to the member 100 in a manner similar to that in the various embodiments discussed above or similar to that shown in FIG. 2(B). Preferably, the device is at least constructed so that front end 222 contacts the surface 122 to enhance stability and provide the third force F3.

Figure 2B:
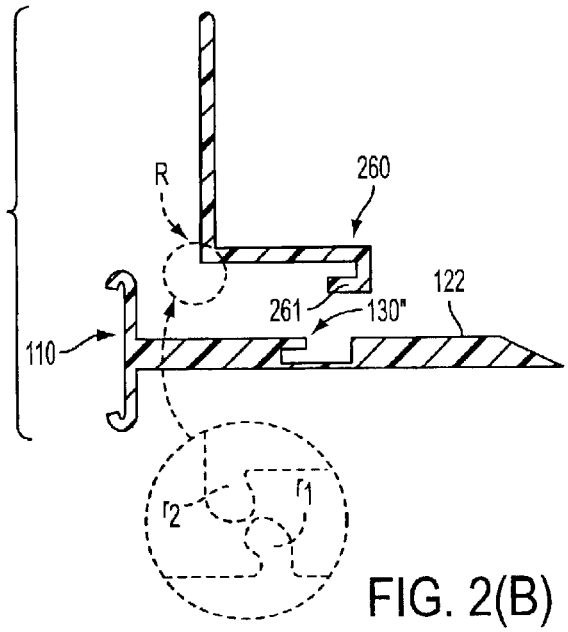

FIG. 2(B) illustrates an embodiment that is similar to the embodiment shown in FIG. 2(A) wherein the upper surface 122 is at a raised elevation such that the horizontal portion 120 is thicker and the overhanging portion 130" is formed by creating a cavity in the portion 120. However, this embodiment requires an increased amount of material for the portion 120 and is, thus, less preferred. Although also less preferred, it is also contemplated that the embodiments shown in FIGS. 1(A)–1(D) can be similarly modified to have a overhanging portion 130 formed within a similar cavity; if required, the end 221 could include a downward step to fit into such a cavity and under the overhanging portion.

As shown in FIG. 2(B), the front end 222 is also preferably snap-fit at a region R. FIG. 2(B) also illustrates that the snap-fit connection can include, as one example, an forward lower bulge r1 and a rearward upper bulge r2. The floor 220 can be, in essence, in tension under such a snap-fit.

Figure 2C:
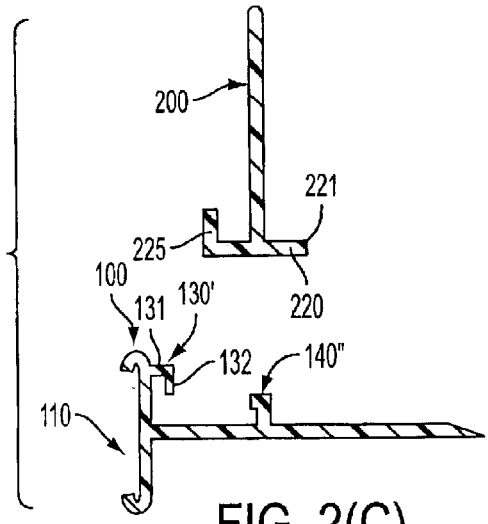
Figure 2D:
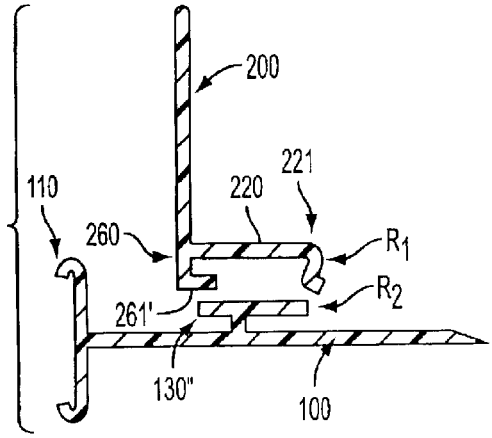

FIGS. 2(C) and 2(D) illustrate additional, although less preferred, embodiments of the invention. In the embodiment shown in FIG. 2(C), the member 200 includes a floor or base 220 having an upward extension 225. On the other hand, the member 100 has an upward protrusion 140" and an overhanging member 130' having an overhanging wall 131 and a downwardly extending wall 132. In the illustrated embodiment, the overhanging member 130' is formed integrally with the label holder 110, but the overhanging member 130' can also be formed separate from the label holder 110. In operation, the portion 225 can be fit under the overhanging member 130' and the end 221 of the floor 220 can be blocked by, or preferably snap-fit to, the protrusion 140".

FIG. 2(C) illustrates one of the less preferred embodiments wherein an overhanging member is proximate a front side and a snap-fit member is proximate a rear side (i.e., reversed from the embodiments shown in FIGS. 1(A)–1(D) and 2(A)–2(B)). In other variations, the embodiment shown in FIG. 2(C) can be reversed (i.e., the attachment of the base 220 to the portion 120 can be reversed) so as to be oriented like that in FIGS. 1(A) through 2(B), and vise-verse. An orientation as shown in FIGS. 1(A) through 2(B) is preferred, however, for resisting counterclockwise CCW movement.

FIG. 2(D) illustrates an embodiment that is similar to that shown in FIG. 2(B), but reversed in orientation. As shown, a rearwardly facing hook 260 engages an overhanging member 130"that is formed with a generally T-shape cross-section. An opposite end of the floor 220 has a snap-fit member R1 that snap-fits over an end R2 of the overhanging member 130". In operation, the portion 261' can be fit under the overhanging member 130" and the portion R1 can be snap-fit to the portion R2. As with the other embodiments, it should be understood that the arrangement could also be reversed to be oriented like that shown in FIGS. 1(A) through 2(B). 1(A) through 2(B).

Figure 3A:
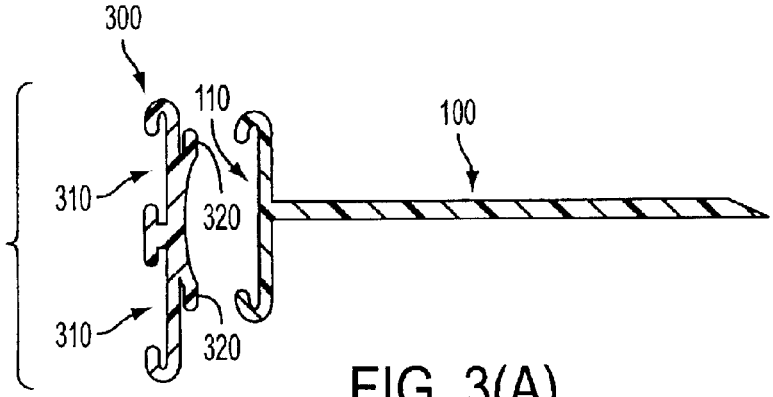
FIG. 3(A) is a cross-sectional side view of another embodiment of the invention having an additional label holder element.
Figure 3B:
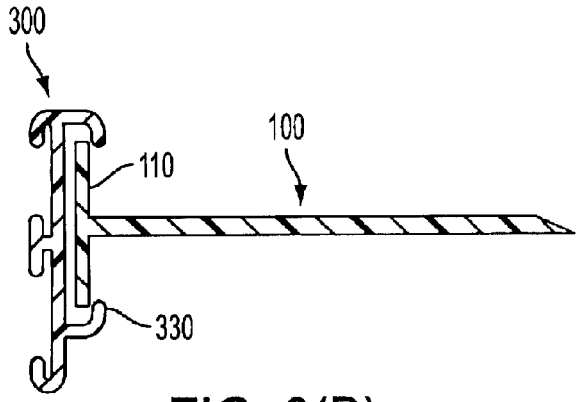
FIG. 3(B) is a cross-sectional side view of another embodiment of the invention having an alternative additional label holder element.
Figure 3C:
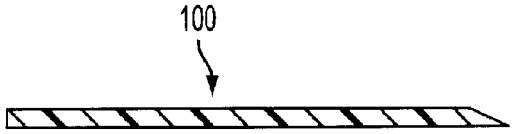
FIG. 3(C) is a cross-sectional side view of another embodiment of the invention without a label holder element.
Figure 3D:
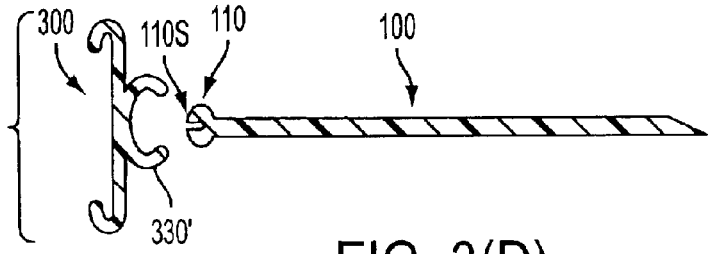
FIG. 3(D) is a cross-sectional side view of another embodiment of the invention having an alternative label holder element.

FIGS. 3(A), 3(B) and 3(D) illustrate embodiments of the label holder 110 having an additional label holder element 300 connected thereto. Although not shown, these embodiments can include any of the attachment methods disclosed herein for mounting a member 200 thereto. The additional label holder element 300 preferably includes a plurality of channels 310 for receiving labels, such as cards. In the embodiments shown in FIGS. 3(A) and 3(B), two channels are included. However, the number can be varied as desired. In the embodiment shown in FIG. 3(A), the label holder element 300 includes rear snap-in legs 320 for securement within a channel of the label holder 110. In the embodiment shown in FIG. 3(B), the label holder 110 is a flat wall that is received within a rear channel 330 of the portion 300. In this manner, the labeling can be modified to accommodate a desired display type for different products or the like. The element 300 can also be constructed to have different numbers of channels and/or to have other label holder configurations.

FIG. 3(D) is a cross-sectional side view of another embodiment of the invention having an alternative label holder 110. As shown, the label holder includes a bead section which snap-fits into a channel 330' of the element 300. The bead section can also include a cut-away slot 110S to enhance flexure of the holder 110 to facilitate connection.

Figure 3E:
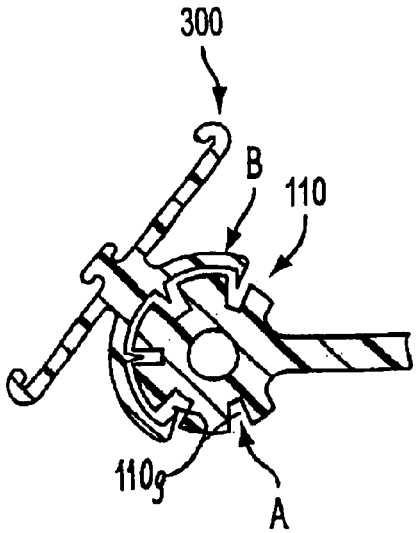
FIG. 3(E) is a cross-sectional side view of an embodiment of the invention having means for selecting a viewing angle of a label.
Figure 3F:
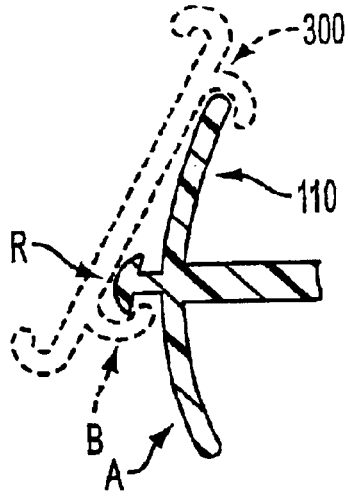
FIG. 3(F) is a cross-sectional side view of another embodiment of the invention having means for selecting a viewing angle of a label.
Figure 3G:
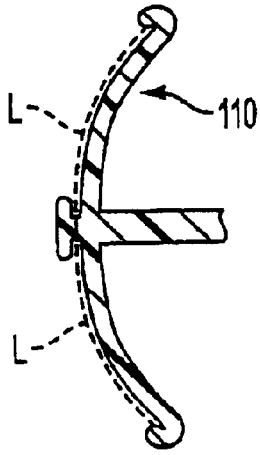
FIG. 3(G) is a cross-sectional side view of still another embodiment of the invention having means for selecting a viewing angle of a label.

FIGS. 3(E), 3(F) and 3(G) illustrate other embodiments of the invention wherein the label holder 110 is configured to allow a label to be placed at a plurality of inclination angles. In these embodiments, a user can select a desired inclination angle of a label to facilitate viewing, such as from above or below the elevation of the label.

In the embodiments shown in FIGS. 3(E) and 3(F), a separate label holder element 300 can be connected to the member 100 at a desired angular position. In these embodiments, the configuration of the label holder element 300 can be varied as desired. In the example shown in FIG. 3(E), for example, the label holder element 300 has two channels, but one or more channels can be used. In these embodiments, the label holder 110 includes a connecting element that cooperates with a connecting element on the label holder element 300 to connect the label holder element at a desired angular position. It is contemplated that the connecting elements can be any known connectors for adjusting an angular position. Most preferably, the attachment is a snap-fit attachment or an interlocking attachment that does not require external parts, such as screws, pins, or the like. In the preferred embodiments where the label holder element 300 and the member 100 are formed by extrusion, such by extruding plastic or aluminum, the connecting elements are preferably co-extruded therewith.

In the exemplary preferred embodiment shown in FIG. 3(E), the connecting element A of the label holder 110 includes a plurality of grooves 110*g* while the connecting element B of the label holder element 300 includes one or more projections for engaging said grooves. Preferably, the connecting element B of the element 300 is generally C-shaped, has a plurality of inner projections, and is flexible to allow the projections to snap-fit into the grooves 110*g*. In the particular construction shown in FIG. 3(E), four positions of the element 300 are available. It should be understood, however, that alternative embodiments can have more or less positions.

Alternatively, the connecting element A can be replaced with a connecting element having a different configuration as long as it can engage a corresponding connecting element B of the label holder 110. For example, the label holder element 300 can have two engaging projections for engaging two such grooves, or in another example just a single engaging projection can be used. Alternatively, the member B could be held in place via friction and compression forces without any interlocking projections. In another alternative embodiment (not shown), the label holder element 300 can be asymmetrical such that it can provide a different angular position merely by mounting it in an inverted position on the holder 110.

FIG. 3(F) shows another exemplary embodiment wherein the label holder 110 has a generally bowed shape and a central ridge R. The holder element 300 includes rear projections that can either engage a bottom of the ridge R and a top of the holder (as shown), or a top of the ridge R and a bottom of the holder to provide two mounting positions of the holder element.

FIG. 3(G) shows another embodiment wherein the label holder 110 is bowed to have a plurality of angular positions for labels thereon. For example, two or more channels (two are shown) can be used to hold labels L for viewing from different positions.

As discussed, although less preferred, the holder member 100 can be formed without a label holder. As one example, FIG. 3(C) shows a cross-sectional side view of another embodiment of the invention without a label holder. In this regard, (a) a label holder could be entirely omitted, (b) a label holder of a shelf S could be used (see, e.g., channel SC in FIG. 1(A)), (c) a label holder could be attached to the member 200 (see, e.g., portion 111' in FIG. 5 and FIGS. 10(A)–10(C) (discussed below)), etc.

Figure 10A:
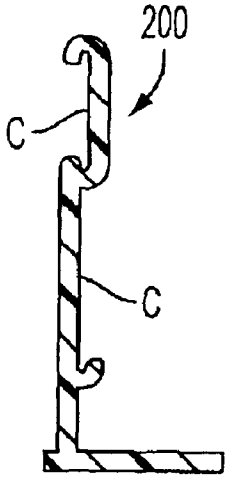
FIGS. 10(A), 10(B) and 10(C) are cross-sectional side views of modified retaining wall members having various label holding means.
Figure 10B:
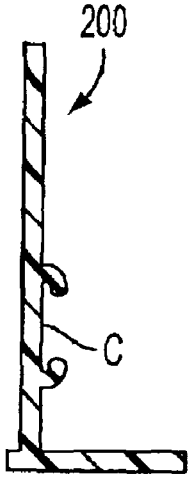
Figure 10C:
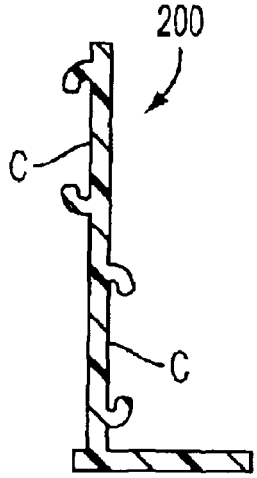

FIGS. 10(A)–10(C) illustrate exemplary embodiments wherein the member 200 is provided with one or more label holder. As shown, the label holders can include one or more channels C on the front and/or back sides of the member 200. The embodiments shown in FIGS. 10(A)–10(C) are exemplary and a variety of other designs, sizes, arrangements and numbers of label holders or channels could be used. When the member 200 includes channels on the back of the member 200 (i.e., facing the rear of the shelf), the member is preferably clear or transparent to enable viewing through the member 200. Although FIGS. 10(A)–10(C) show label holders integrally formed with the member 200 (preferably by extrusion), it is contemplated that separate label holder elements (not shown) similar to the label holder elements 300 of the various embodiments described herein could be similarly connected to the member 200, if desired.

Preferred Construction

The members 100 and 200 are preferably formed of a plastic material. Most preferably, the plastic material is extruded to form the members 100 and 200. However, the members can be injection molded, vacuum formed, or formed in other known ways. Alternatively, one or both of the members could be made from composite materials, aluminum (preferably, an extruded aluminum), roll formed metals (e.g., sheet metal), or from other suitable materials.

As some non-limiting examples, the members 100 and 200 can be made with one or more of the following plastics: polycarbonate, butyrate, propionate, acetate, acrylic, acrylic DR, styrene, PVC, PVC acrylic, as well as with any other suitable plastics. As noted above, the member 100 is preferably clear or transparent so that product on the shelf can be viewed therethrough.

In preferred embodiments, the member 200 is formed so that the width W of the base or floor 220 is less than about 3–5 inches, more preferably between about ¼ to 2 inches, and even more preferably between about ½ and 1 inch. It is contemplated, however, that these sizes can vary significantly depending on circumstances. The width W of the floor 220 is preferably sized to provide sufficient stability while still minimizing rearward extension into the product containing area of the shelf.

The member 100 can be sized, for example, so that the portion 120 has a length sufficient to support the member 200 on the shelf. Typically, the length will be a matter of inches. The portion 120 can also extend across the entire shelf floor to provide a consistent and smooth sliding surface (see, e.g., FIG. 8(B)).

In one exemplary embodiment, the thicknesses of the members 100 and 200 are in a range of about 0.04 to 0.125 inches. It is again contemplated, however, that these sizes can be varied greatly depending on circumstances.

In one exemplary construction, the height H of the wall 210 is between about ½ inch to 6 inches. When a plurality of different members are provided, the members can have heights H, for example, throughout a range of between about ½ inch to 6 inches.

In one exemplary embodiment, the members 100 and 200 can have a length sufficient to extend across a substantial portion of a shelf front in a store, or across an entire shelf front. For example, the members 100 and 200 can have a length of between about 2–5 or between about 2–10 feet long.

Figure 8B:
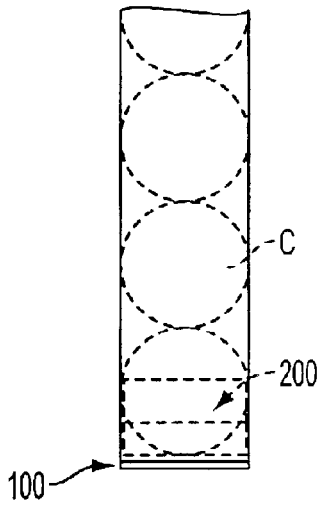
FIG. 8(B) is a top view of an embodiment of the invention on a narrow shelf region.

In another exemplary embodiment, the members 100 and 200 can be relatively short so as to fit across a narrow shelf region. As shown in FIG. 8(B), for example, the members can be made to span only a few inches (such as, for example only, less than about 6 inches) so as to support a single row of items C there-behind. The items C can be, for example, soft drink cans or other items, and can be, for example, supported on an angled shelf as shown in FIG. 8(A).

Additional Modifications

Although the members 100 are illustrated as being generally T-shaped, the portion 110 can be at a variety of positions with respect to the portion 120. For example, the angle can be about 90 degrees, as shown, or it can be varied to facilitate viewing by a customer depending on shelf location. As discussed above, the portions 300 can also be modified to provide a desired angle.

Figure 6:
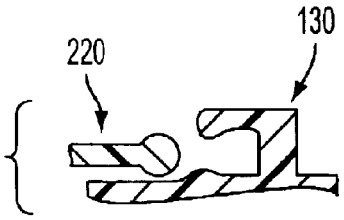
FIGS. 6 and 7 are cross-sectional side views of alternative manners of engagement between the retaining wall element and the overhanging member of the type, e.g., shown in FIG. 1(A)
Figure 7:
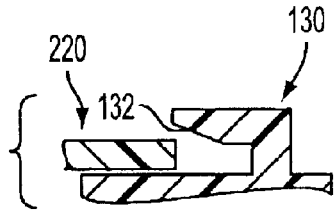

The embodiments described above can also be modified to have the overhanging members 130, 130', 130" snap-fit to the member 200. In the embodiment shown in FIG. 1(A), for example, the end 221 can include a bulge that is snapped beneath the overhanging member 130, as shown in FIG. 6. As another alternative, the overhanging members, e.g., 130, etc., could be constructed to create a wedge-fit wherein the end 221 is wedged therein. As shown in FIG. 7, for example, the portion 131 can have an angled surface 132 to provide a wedging action as the end 221 is pushed thereunder. These snap-fit and wedge engagements can also provide a means for applying a force F1 to resist forward motion of the second plastic strip (i.e., this can be an additional means or the only means for applying the force F1).

Although much less preferred, as discussed above, it is contemplated that the locations of the overhanging members, e.g., 130, etc., and the snap-fit or blocking portions can be reversed with one another, such that the overhanging member, e.g., 130, etc., overhangs over the front end 222 of the floor and the snap-fit or blocking action is at or near the rear end 221. The wall portion 210 would be located at a distance behind the end 222 at least sufficient to allow the overhanging member, e.g., 130, etc., to engage the floor 220. This type of embodiment can be used, for example, where there is a greater concern that the wall 210 will be forced to move in a clockwise direction, rather than in a counterclockwise direction.

In less preferred embodiments, snap-fit connection can be made at both the front end 222 and the rear end 221, without any overhanging member. For enhanced stability, however, this alternative is less preferred. Even less preferred, a single snap-fit connection can be formed along the bottom of the base 220, while the base can be used to stabilize without additional restraint (i.e., additional restraint via a snap-fit or overhanging connection) at one or both of the front and rear ends 222 and 221.

If desired, vertical partitions (not shown) can be included which extend perpendicular to both the wall 210 and the portion 120. The partitions can, for example, be snap-fit to the portion 120, to the floor 220, and/or to the wall 210. The partitions can be constructed, e.g., similar to the shelf dividers shown in U.S. Pat. No. 5,341,945 (see dividers 12), the disclosure of which is incorporated herein by reference.

Assembly Kit

Figure 5:
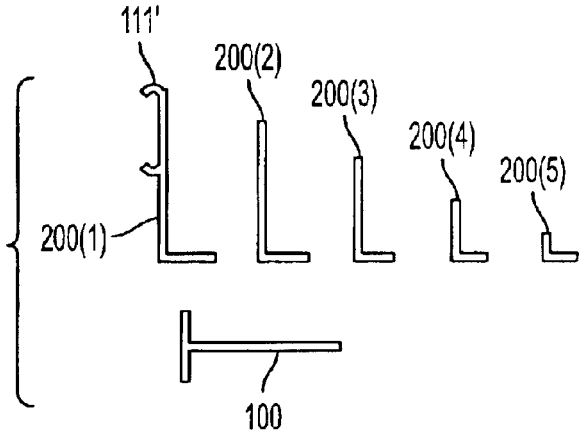
FIG. 5 is a schematic diagram illustrating an assembly kit according to the invention having a plurality of interchangeable retaining wall elements.

The present invention is preferably provided as a kit having a plurality of different retaining wall members 200 that are each attachable to the same holder member 100. For example, as shown in FIG. 5, a plurality of retaining wall members 200(1)–200(5) having different wall heights H can be provided to enable the retaining wall height to be changed as desired. Although five members 200 are shown, the number of different members 200 can be varied. In addition, different retaining wall members 200 can be used to change to clear or to opaque wall members, or to change to wall members having label holders thereon (such as the channel 111' shown in FIG. 5, etc.), or to change to wall members having printing or the like thereon.

Integrated with Shelf

Figure 9A:
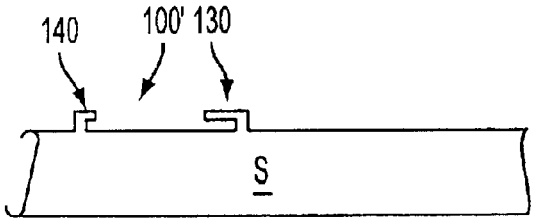
FIGS. 9(A) and 9(B) are cross-sectional side views of embodiments of the invention wherein the holder member is integrated into the shelf structure.
Figure 9B:
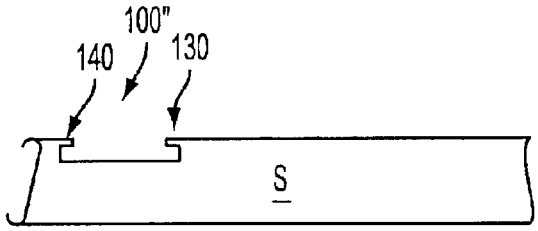

In an alternative construction of any of the embodiments disclosed herein, a shelf can be constructed to incorporate the structure of the holder member 100. As some examples, FIGS. 9(A) and 9(B) show shelves S with holder members 100', 100" integrally formed therein. The embodiments shown in FIGS. 9(A) and 9(B) are similar to that shown in FIG. 1(A), with an upward protrusion 140 and an overhanging member 130 integrally formed in the shelf.

The shelf S can be made of metal (e.g., sheet metal), plastic (e.g., injection molded, extruded, etc.), wood or any other suitable material. In one preferred embodiment, however, the shelf S is made from a roll formed sheet metal material. Most preferably, the shelf is constructed such that the top surface of the shelf is formed from a single sheet of material that is bent (e.g., via known roll forming processes, etc.) so as to include the holder member portions integral therewith.

Figure 9C:
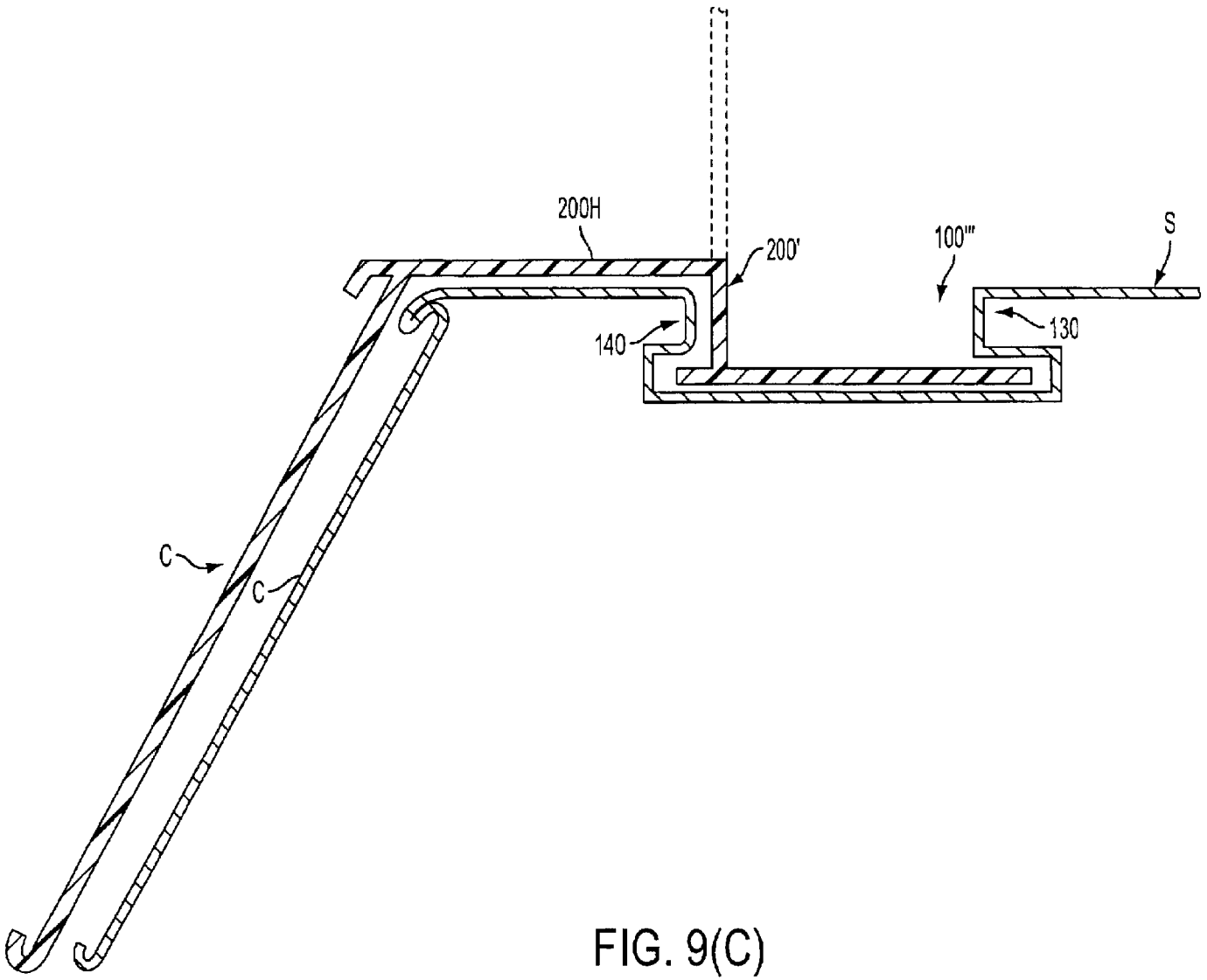
FIG. 9(C) is a cross-sectional side view of another embodiment wherein the holder member is integrated into the shelf structure.

Another example of a shelf that is constructed to incorporate the structure of the holder member is shown in FIG. 9(C). In this embodiment, the shelf is preferably formed of a sheet metal that is roll formed so as to include a holder member 100'" in the upper surface thereof. As shown, the sheet metal shelf can include a channel C integral with the shelf at the front end of the shelf as is known in the art. In the illustrated embodiment, the member 200' can be constructed to include a portion 200H that extends laterally toward the front of the shelf and a label holder, such as a channel C, formed at the front of the member 200'. Alternatively, the member 200' can extend upwards as shown in dashed lines in FIG. 9(C) so as to form a retaining wall similar to that described above in other embodiments. Alternatively, the member 200' can include both a retaining wall and a front channel as shown or the member 200' can be formed into a variety of other shapes, configurations, etc., known in the art or desired based on circumstances.

Figure 9D:
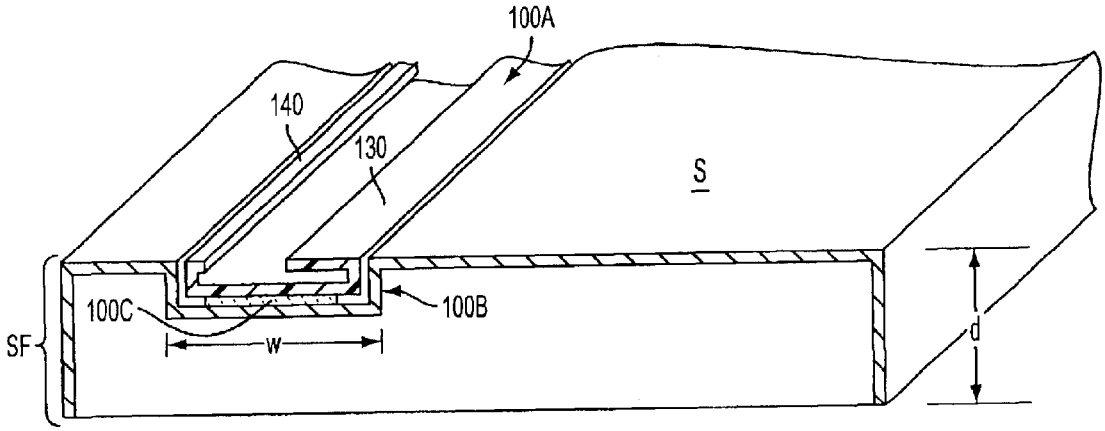
FIG. 9(D) is a cross-sectional perspective view of another embodiment wherein the shelf is adapted to include a holder member therein.

FIG. 9(D) shows another embodiment of a prefabricated shelf S that is adapted to readily include a modified holder member. As shown, the shelf S preferably includes a groove or channel 100B formed proximate the front side SF of the shelf. In less preferred embodiments (not shown), the channel 100B can be formed such that the bottom of the channel extends all the way to the front side SF of the shelf. As shown, a holder member element 100A is located within the channel 100B. The holder member element is preferably formed with means (e.g., elements 130, 140 or any other structure as described herein) for mounting another member, e.g., members 200, 200', 200" (FIG. 9(E)), as in other embodiments described herein.

The element 100A can be mounted within the channel 100B in a variety of ways. For example, an adhesive tape 100C (e.g., a foam tape, etc.) can be used, as shown. Alternatively, the element 100A can be attached via adhesives, screws, rivets, bolts, clips, or any other known attachment means.

This latter embodiment has appreciable advantages in that, for example, the structure of the shelf S can be greatly simplified while easily being adapted to include various elements of the present invention to provide versatility, etc. Notably, the channel 100B can include a simplified structure (e.g., without overhanging portions) that can be easily formed into the shelf. For instance, a channel 100B can be easily formed by punching (e.g., with a reciprocated punch press) into a flat sheet material to form the shelf. As another example, the channel 100B can also be easily formed by bending the sheet material by simplified techniques (e.g., around forming blocks, etc.) other than more expensive and/or complex techniques using roll forming machines.

Furthermore, the shelf S can be formed without an integral or attached front channel portion at the front end SF. Typically, shelf manufacture can be expensive and complex due to the need to include a front channel like that shown in FIG. 9(C) and as commonly included on store shelf fronts. As a result, the shelf structure S can be simplified, while maintaining versatility, etc. These simplifications can have substantial benefits and cost savings in view of the great number of shelf fronts used in merchandizing stores world wide.

In some non-limiting and exemplary constructions of the shelf S, the depth d of the shelf S can be approximately between about 1 to 1½ inches, the height h of the channel to the bottom thereof can be less than about ½ inch, or even less than about ⅓ inch, and the width w of the channel can be slightly larger than about the size of the widths W of the floor 220 described above. It should be understood that various sizes can be selected based on circumstances.

The member 100A is preferably constructed so as to accommodate a member 200, 200', or 200" (discussed below in relation to FIG. 9(E)), as in other embodiments described herein. As a result, the simplified shelf S can be readily adapted to include a vertical retaining wall and/or shelf front label(s) in an extremely versatile and adaptive manner.

Figure 9E:
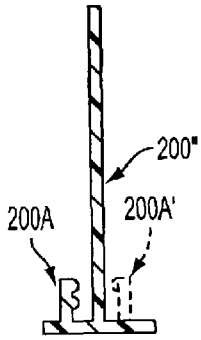
FIGS. 9(E) through 9(G) are cross-sectional side views of various holder members that can be used in various embodiments of the invention.

FIG. 9(E) shows another exemplary member 200" wherein the member includes a vertical wall and an upstanding retaining portion 200A which is somewhat flexible or which includes flexible protrusions facing the retaining wall. The member 200" is preferably formed so as to mount on the member 100A in a manner like that discussed above with reference to other embodiments disclosed herein.

Figure 9F:
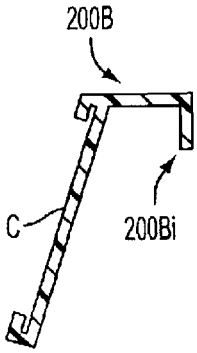
Figure 9G:
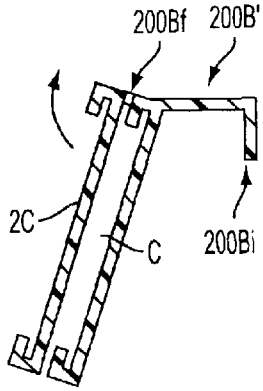

The flexible member 200A is provided to allow the member 200" to mount an additional label holding member 200B, such as shown in FIGS. 9(F) or 9(G). In the embodiment shown in FIG. 9(F), the member 200B includes a rear insert extension 200Bi that is configured to be press fit or snap fit to create a friction engagement between the member 200A and the retaining wall of the member 200". The member 200B is configured so that a label holding portion (e.g., a channel in the shown embodiment) can be located at a front end of the shelf, such as like that shown in FIG. 9(C). The member 200B' shown in FIG. 9(G) is similar to that shown in FIG. 9(F) except that the member 200B' includes a second label holder, e.g., channel 2C, mounted over the first label holder, e.g., channel C, via a flexible portion 200Bf. In this manner, product labeling for the consumer (e.g., price, names, etc.) can be provided for normal display on the channel 2C while labeling for business use (e.g., bar codes, etc.) can be provided on the channel C, whereby the store owner can pivot the portion 2C in the direction of the arrow shown to expose the channel C for inventory and other business purposes.

In one alternative embodiment, a portion 200A' can be formed, if desired, on an interior—product side—of the retaining wall as shown in FIG. 9(E). The portion 200A' can be used to retain product dividers (i.e., dividers adapted with an insert similar to 200Bi) in a manner generally similar to, for example, dividers 12 shown in U.S. Pat. No. 5,341,945, the entire disclosure of which is incorporated herein by reference.

Figure 9H:
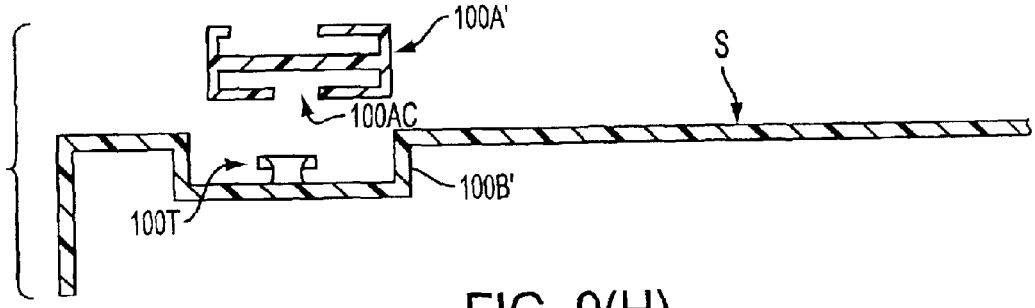
FIG. 9(H) is a cross-sectional side view of another embodiment wherein the shelf is adapted to include a holder member therein.
Figure 9I:
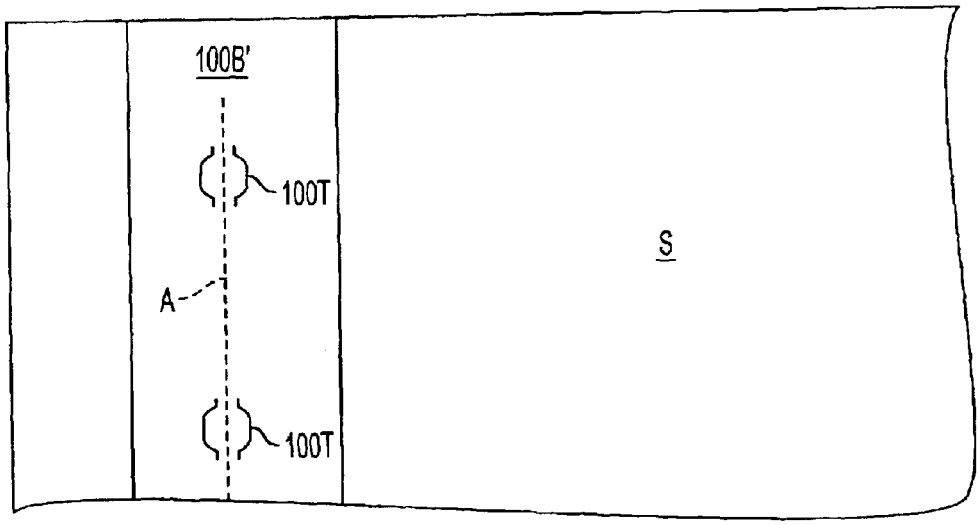
FIG. 9(I) is a top view of the shelf of the embodiment shown in FIG. 9(H)

FIGS. 9(H)–9(I) shown another embodiment of the invention that is similar to the embodiment shown in FIG. 9(D). However, the embodiment shown in FIG. 9(H) includes a different method of attaching the holder member element 100A' to the channel 100B'. As shown, a plurality of upstanding tabs 100T are preferably formed on a bottom of the channel along an axis A extending along the length of the channel. The tabs 100T preferably have a generally T-shape as shown in FIG. 9(H) so as to form overhanging portions that can engage a bottom of the member 100A'. Specifically, the member 100A' is preferably formed with a bottom channel 100AC that is adapted to engage with the top of the tabs 100T. That is, the width of the channel 100AC is preferably narrower than the width of the top of the tabs 100T. In order to form the attachment, the channel 100AC is preferably snap-fit to the tabs due to resiliency in the member 100A' adjacent the channel. Alternatively, the member can be rigid at the channel and can be attached by sliding the member 100A' laterally into the channel 100B' such that the tabs 100T are received in the channel 100AC from a side thereof.

Figure 9J:
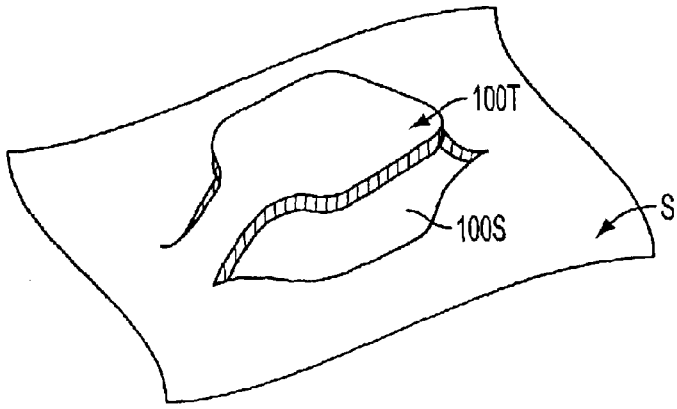
FIG. 9(J) is a top perspective view of a tab portion of the shelf shown in FIG. 9(H)

In one exemplary construction, the shelf S can be formed of a sheet metal material. The channel 100B' can be formed therein as discussed above and the tabs 100T can be formed by punching the sheet metal material upward from the bottom side of the shelf using known techniques. As shown in FIG. 9(J), the tabs 100T can be made as bent sections that are separated from a planar surface of the shelf at regions 100S at opposite sides thereof. It should be understood that this is just one illustrative embodiment and that tabs can be formed in a variety of ways. As one other example, tabs could be added to the shelf as separate members. In addition, a single elongated tab member could extend along the length of the axis A (e.g., the tab could be roll formed, extruded, etc.).

The members 200', 200", 200B, 200B', 100A and 100A' shown in FIGS. 9(C)–9(H) can be made in a manner similar to any of the members 100 and/or 200 described herein (see, e.g., the following section). As indicated, the members are most preferably formed by extrusion. Most preferably, the members are made with extruded plastic. Alternatively, the members can be made with extruded aluminum or other appropriate materials, such as described herein. Alternatively, the members can be made with injection molding or other manufacturing methods. Any other methods of fabrication described herein or known to be appropriate to those in the art based on this disclosure can also be used.

It is noted that in the embodiments shown in FIGS. 9(D) and 9(H), the members 100A and 100A' are most preferably formed so as to fit entirely below a plain of the top surface of the shelf S when mounted within the channels 100B and 100B', respectively. The members 100A and 100A' could also be made, in less preferred embodiments to extend slightly above the top surface of the shelf. In less preferred embodiments, the members 100A and 100A' may extend up to about ¼ inch above the top of the shelf. In even less preferred embodiments, the members 100A and 100A' may extend up to about ½ inch above the top of the shelf. However, it is much preferred to design the members such that they do not obstruct use of the shelf 100A and 100A', especially when no additional members are present thereon. It should also be understood that the present invention is most preferably utilized with shelves having planar support top surfaces, which can be, for example, horizontal or, in some cases, tilted.

Extruded Construction

As discussed above, the members 100 and 200 are most preferably formed by extruding a plastic material through an extrusion die and cutting appropriate section lengths during the extrusion process. The member 100 is preferably an integrally extruded single piece, and the member 200 is also preferably an integrally extruded single piece. That is, the members 100 and 200 are preferably solid pieces that are extruded through individual dies, rather than having two or more sections that are attached together. The members 100 and 200 can, thus, be formed with a generally constant and continuous cross-sectional shape.

Whether formed by extrusion or by other means (e.g., injection molding, machining, etc.), the cross-sections shown in the FIGS. are preferably generally constant and continuous over the entire lengths of these members. In this manner, the attachment means between the members 200 and the members 100 can attach the members together at any position along the lengths thereof.

Advantages and Benefits

The present invention has substantial advantages and benefits over existing art. As should be appreciated, the advantages discussed herein are not necessarily applicable to each and every aspect or embodiment.

As described above, the present invention can be easily and inexpensively fabricated. The present invention can be constructed with a limited amount of material. The present invention also can have a minimal size to prevent obstruction and/or interference with normal shelf use. Nevertheless, the assembled device can be very strong and stable to provide a strong and stable shelf-front retaining wall.

The present invention can be easily handled and manipulated. The store owner does not need to have additional parts or tools for assembly. The present invention enables a store owner to change the retaining wall type very easily. During normal store operation, a store owner may often desire to rearrange products on shelves or to provide new products on shelves. Rearranging and/or organizing products on shelves can be very time consuming and difficult. Valuable time and money can be lost during such rearranging and/or organizing. When products are not well organized and/or accommodated on a shelf, the products can be damaged (e.g., if products fall from the shelves) and consumers can have difficulty locating products and can become dissatisfied with shopping under such conditions. It can be important to be able to quickly and easily rearrange and/or reorganize products as desired.

With the preferred embodiments of the present invention, a store owner can quickly attach a shelf-front wall as may be desired for a particular product type. A store owner can also have an employee change the assembly because no additional parts are needed and little or no instruction is needed. As a result, a front wall can be easily set at a desired height sufficient to retain products. In addition, shelf-front walls of various types can be used, such as clear, opaque, printed, etc. The rearrangement and/or reorganization of products is thus greatly facilitated.

In addition, embodiments like that shown in FIGS. 1(B) and 1(C)—wherein the snap-fit engagement is effected by a socket and plug type connection—can be beneficial when the width W of the floor 220 varies slightly, such as due to inconsistencies resulting in an extrusion process. That is, the overhanging member 130 can extend a large enough distance over the end 221 to allow a gap to exist between the end 221 and the vertical portion of the member 130. As a result, any dimensional variation in the width W resulting during formation, such as during extrusion thereof, should not inhibit connection.

While the present invention has been shown and described with reference to preferred embodiments presently contemplated as best modes for carrying out the invention, it is to be understood that various changes may be made in adapting the invention to different embodiments without departing from the broader inventive concepts disclosed herein and comprehended by the claims which follow. It is also to be understood that features from the various embodiments can be incorporated into and/or interchanged with features of other embodiments herein where appropriate.

What is claimed is:

1. A method of making a shelf-front assembly, comprising the steps of:

extruding a plastic strip having 1) a generally horizontal floor and 2) an upward wall extending up from said generally horizontal floor;

cutting a length of said plastic strip;

attaching the length of the plastic strip on a shelf by sliding a portion of said generally horizontal floor in a depthwise direction under an overhanging member and laying said generally horizontal floor with a blocking element in front of a retaining surface of said strip;

wherein when attached to said shelf said upward wall is located substantially over said shelf.

2. The method of claim 1, wherein said overhanging member overhangs a rear end of said floor and further including overhanging said overhanging member over a rear end of said floor.

3. The method of claim 1, further including the steps of a) extruding a modified strip that is similar to said strip with an upward wall that is a different height than said upward wall of said strip; b) removing said strip from said shelf and attaching said modified strip to said shelf to provide a different height upward wall.

4. The method of claim 1, wherein said blocking element is also a snap-fit element and further including the step of snap-fitting said blocking element to said strip.

5. The method of claim 1, further including retaining items for sale on said shelf by said upward wall.

6. The method of claim 1, further including forming said upward wall with a height of between ½ inch and 6 inches.

7. The method of claim 1, further including forming said generally horizontal floor with a depth of less than 3 to 5 inches.

8. The method of claim 1, further including forming said generally horizontal floor with a depth of between ¼ inch to 2 inches.

9. The method of claim 1, further including forming said generally horizontal floor with a depth of between ½ inch to about 1 inch.

10. The method of claim 1, further including forming said strip with a length of at least 2 feet long.

11. A method of making a shelf-front assembly, comprising the steps of:

a) locating an elongated strip, which has a floor and an upward wall with a substantially narrower depth than said floor, proximate a front of a shelf, said shelf having an overhanging member extending lengthwise along said shelf; and b) placing an edge of said floor under said overhanging member by moving said elongated strip depthwise over said shelf without substantial movement lengthwise over said shelf;

c) wherein when attached to said shelf said upward wall is located substantially over said shelf.

12. The method of claim 11, wherein said placing includes sliding said edge of said floor rearwardly under said overhanging member.

13. The method of claim 11, further including integrally forming said overhanging member as a unitary piece with said shelf.

14. The method of claim 13, further including providing said shelf as a metal shelf.

15. The method of claim 14, further including roll-forming said shelf and said overhanging member together.

16. The method of claim 11, further including providing said elongated strip as an extruded strip.

17. The method of claim 16, further including providing said elongated strip as a plastic strip.

18. The method of claim 11, further including retaining items for sale on said shelf by said upward wall.

19. The method of claim 18, further including providing said upward wall as generally transparent to facilitate viewing of said items therethrough.

20. The method of claim 11, further including forming said upward wall with a height of between ½ inch and 6 inches.

21. The method of claim 11, further including forming said generally horizontal floor with a depth of less than 3 to 5 inches.

22. The method of claim 11, further including forming said generally horizontal floor with a depth of between ¼ inch to 2 inches.

23. The method of claim 11, further including forming said generally horizontal floor with a depth of between ½ inch to about 1 inch.

24. The method of claim 11, further including forming said strip with a length of at least 2 feet long.

25. A method of assembling a shelf-front assembly with plural retaining walls that are interchangeable by depthwise movement without substantial lengthwise movement, comprising the steps of:

a) locating an elongated strip, which has a floor and an upward retaining wall over said floor with a substantially narrower depth than said floor, proximate a front of a shelf, said shelf having an overhanging member extending lengthwise along said shelf;

b) placing an edge of said floor under said overhanging member by moving said elongated strip depthwise over said shelf without substantial movement lengthwise over said shelf; and c) further including the steps of a) providing a modified strip that is similar to said strip with an upward retaining wall that is a different height than said upward retaining wall of said strip; b) removing said strip from said shelf and attaching said modified strip to said shelf to provide a different height upward retaining wall.

26. A method of making a shelf-front assembly, comprising the steps of:

a) locating an elongated strip, which has a floor and an upward wail over said floor with a substantially narrower depth than said floor, proximate a front of a shelf, said shelf having an overhanging member extending lengthwise along said shelf; and b) placing an edge of said floor under said overhanging member by moving said elongated strip depthwise over said shelf without substantial movement lengthwise over said shelf; and c) wherein said edge of said floor under said overhanging member is a rearmost end of said floor.

27. A method of making a shelf-front assembly, comprising the steps of:

a) extruding a plastic strip having 1) a generally horizontal floor and 2) an upward wall extending up from said generally horizontal floor;

b) cutting a length of said plastic strip;

c) attaching the length of the plastic strip on a shelf by sliding one end of said generally horizontal floor under an overhanging member and laying said generally horizontal floor with a blocking element in front of a retaining surface of said strip;

d) further including the steps of i) extruding a modified strip that is similar to said strip with an upward wall that is a different height than said upward wall of said strip and ii) removing said strip from said shelf and attaching said modified strip to said shelf to provide a different height upward wall.

* * * * *